US005622071A

United States Patent [19]

Van Riper et al.

[11] Patent Number: 5,622,071

[45] Date of Patent: Apr. 22, 1997

[54] METHOD FOR FORMING A FLANGE ON A TUBE

[75] Inventors: Philip C. Van Riper, Holland; Gene A. Ellerbrock, Columbus Grove, both of Ohio

[73] Assignee: Aeroquip Corporation, Maumee, Ohio

[21] Appl. No.: 562,734

[22] Filed: Nov. 27, 1995

[51] Int. Cl.[6] ..... B21D 19/04

[52] U.S. Cl. ..... 72/117

[58] Field of Search ..... 72/115, 117, 124

[56] References Cited

U.S. PATENT DOCUMENTS

| | | | |
|---|---|---|---|
| 168,970 | 10/1875 | Caswell . | |
| 1,853,641 | 4/1932 | Seward | 72/117 |
| 3,042,965 | 7/1962 | Gray, Jr. et al. | 18/1 |
| 3,590,455 | 7/1971 | Harris | 29/157 |
| 3,606,659 | 9/1971 | Robbins | 29/157 |
| 3,668,754 | 6/1972 | Boast | 29/157 |
| 4,091,648 | 5/1978 | McCaslin | 72/124 |
| 4,761,873 | 8/1988 | Wetzel et al. | 29/517 |
| 4,809,418 | 3/1989 | Burli | 29/237 |
| 5,131,145 | 7/1992 | Badoureaux | 29/890 |

FOREIGN PATENT DOCUMENTS

| | | | |
|---|---|---|---|
| 1400718 | 6/1988 | U.S.S.R. | 72/124 |

*Primary Examiner*—Lowell A. Larson

*Attorney, Agent, or Firm*—Emch, Schaffer, Schaub & Porcello Co., L.P.A.

[57] ABSTRACT

The present invention is a method for forming a flange on a tube. The method of the present invention includes the steps of: (a) placing a tube having a tube axis extending longitudinally therethrough on a support device for supporting the tube, the tube having an edge defining an opening, the support device having a predetermined flange shape surface adjacent the edge; (b) positioning a tip having a tip axis extending longitudinally therethrough adjacent the edge, the tip having a substantially hyperbolioidal shape, the tip axis being at a predetermined angle with respect to the tube axis, the tip rotating along the tube and tip axes; (c) inserting the rotating tip in the opening of the tube; and (d) engaging the edge with the tip to cause the edge to contact the predetermined flange shape surface to form a flange on the tube.

14 Claims, 4 Drawing Sheets

METHOD FOR FORMING A FLANGE ON A TUBE

BACKGROUND OF THE INVENTION

The present invention relates generally to a method for forming a flange on a tube. More specifically, the invention is directed to a method for forming a flange on a tube using a tip having, among other things, a hyperbolioidal shape.

Methods for forming flanges on tubes are known in the art. An example of the prior art method is shown in U.S. Pat. No. 5,131,145. It has been found that the prior art methods do not allow the forming of flanges on tubes having a variety of outer diameters and wall thicknesses. Therefore, there is a need for a method that can form flanges on a variety of tubes. The present invention satisfies the above-identified need.

SUMMARY OF THE INVENTION

The present invention is a method for forming a flange on a tube. The method of the present invention includes the steps of: (a) placing a tube having a tube axis extending longitudinally therethrough on a support device for supporting the tube, the tube having an edge defining an opening, the support device having a predetermined flange shape surface adjacent the edge; (b) positioning a tip having a tip axis extending longitudinally therethrough adjacent the edge, the tip having a substantially hyperbolioidal shape, the tip axis being at a predetermined angle with respect to the tube axis, the tip rotating along the tube and tip axes; (c) inserting the rotating tip in the opening of the tube; and (d) engaging the edge with the tip to cause the edge to contact the predetermined flange shape surface to form a flange on the tube.

It is the primary object of the present invention to provide a method of forming a flange on a tube.

It is an important object of the present invention to provide a method to allow for the forming of flanges on a variety of tubes.

Other objects and advantages of the invention shall become apparent to those skilled in the art upon a review of the following detailed description of the preferred embodiment and the accompanying drawings.

DETAILED DESCRIPTION OF THE PREFERRED EMBODIMENT

Figure 1A:
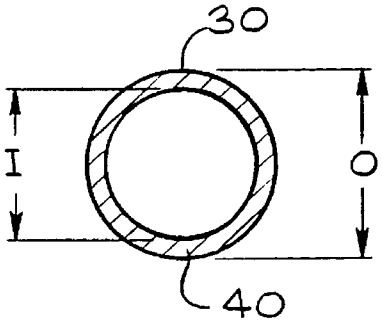
FIG. 1A is a cross-sectional view taken along line 1A—1A of FIG. 1.
Figure 2:
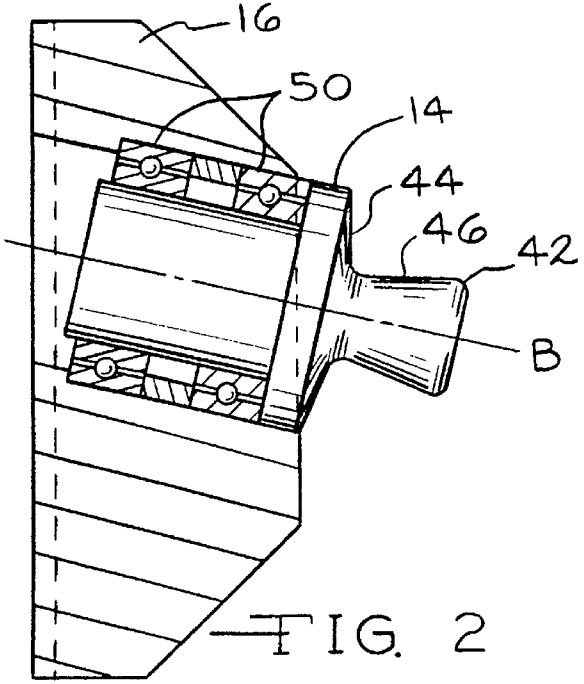
FIG. 2 is a cross-sectional view taken through the center of the tip, slide and bearings of the device shown in FIG. 1.
Figure 1:
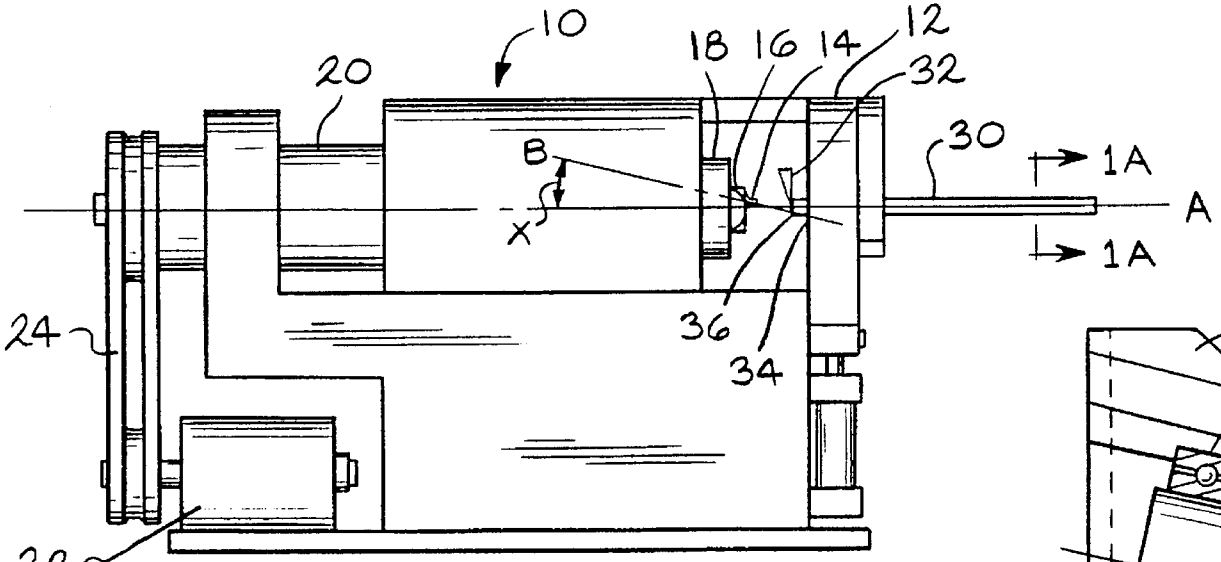
FIG. 1 is a side elevational view showing the tube, die for supporting the tube, tip and device for rotating the tip that can be used to practice the method according to the present invention.

The preferred embodiment and best mode of the present invention will now be described in detail with reference to the accompanying drawings. The present invention is directed to a method for forming a flange on a tube. An example of a device that can be used to practice the method of the present invention is shown in FIGS. 1 and 2. The device is indicated generally in the drawings by reference No. "10". As shown in FIG. 1, the device 10 includes a support device or die 12, a tip 14 mounted on a slide 16, a head 18 that supports the slide 16, a shank 20 connected to the head 18, and a motor 22 operatively connected to the shank 20 by a drive belt 24. It should be understood that other devices can be used to practice the present invention.

Figure 5:
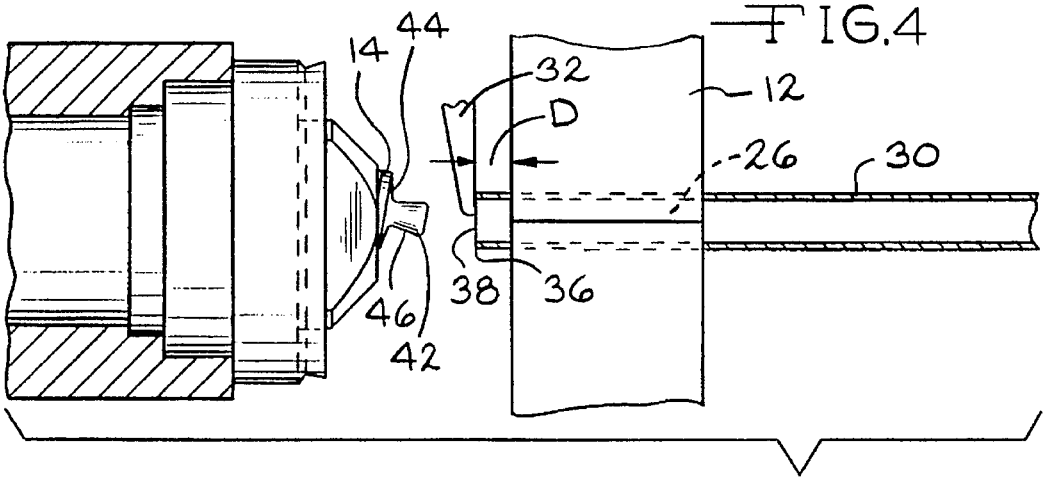
FIG. 5 is a side elevational view showing the tip, die and tube with the tube inserted in the die adjacent the tube stop.
Figure 9:
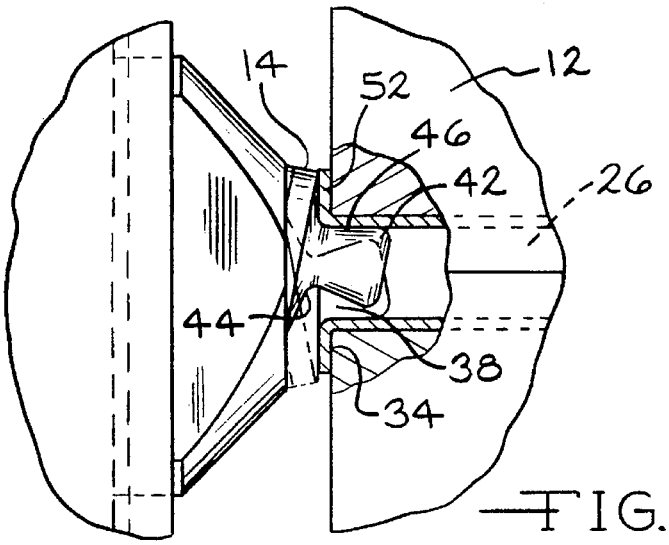
FIG. 9 is a detailed view showing the tip rotating with respect to the tube to form a flange on the tube.

As shown in FIGS. 1 and 5, the die 12 defines a tube opening 26 that receives a tube 30. The tube opening 26 is preferably round and has a diameter that corresponds to the outside diameter of the tube 30. The die 12 includes a tube stop 32 adjacent the tube opening 26. As shown in FIG. 5, the tube stop 32 is positioned a predetermined distance D from the tube opening 26. The predetermined distance D between the tube stop 32 and the tube opening 26 determines the ultimate size of the flange to be formed on the tube 30. It has been found that the predetermined distance D between the tube stop 32 and the tube opening 26 should be in the range from about 0.110 inch to about 0.120 inch, with 0.115 inch being preferred. As shown in FIG. 9, the die 12 includes a predetermined flange shape surface 34 adjacent the tube opening 26. The flange shape surface 34 is the surface upon which the flange of the tube will be formed in the method of the present invention.

As shown in FIGS. 1 and 5, the tube 30 can be placed in the tube opening 26 of the die 12. The tube 30 includes a tube axis A that extends longitudinally therethrough. The tube 30 includes an edge 36 that defines an opening 38. As shown in FIG. 1A, the tube 30 includes an outside diameter 0 and an inside diameter 1. In the preferred embodiment, the tube 30 has an outside diameter 0 of 0.50 inch. The tube 30 also includes a wall 40 having a predetermined wall thickness. In the preferred embodiment, the preferred wall thickness is in the range from about 0.035 inch to about 0.070 inch, with 0.049 inch being preferred. If the outside diameter 0 is 0.50 inch and the wall thickness is 0.049 inch, the inside diameter 1 is 0.402 inch. It should be understood that the present invention can be used on a variety of tubes having a variety of outside diameters and wall thicknesses, with the above-identified dimensions being preferred.

Figure 6:
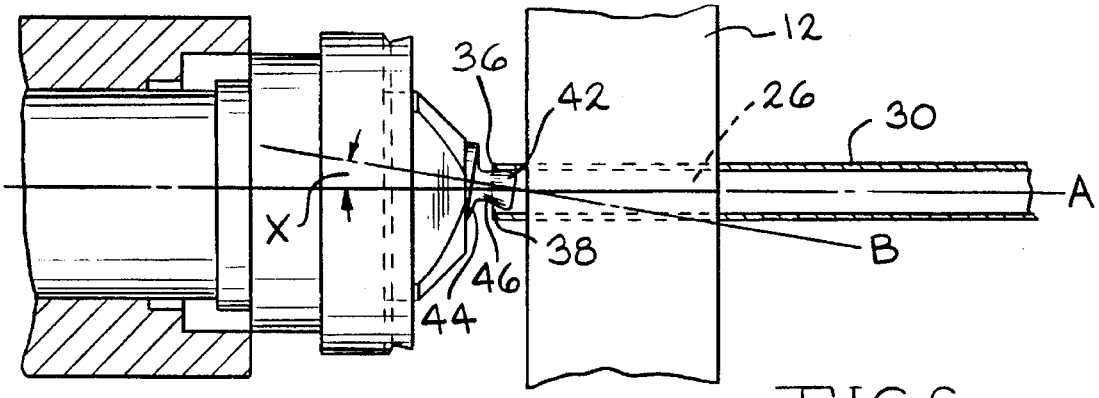
FIG. 6 is a side elevational view showing the insertion end of the tip inserted in the tube.
Figure 7:
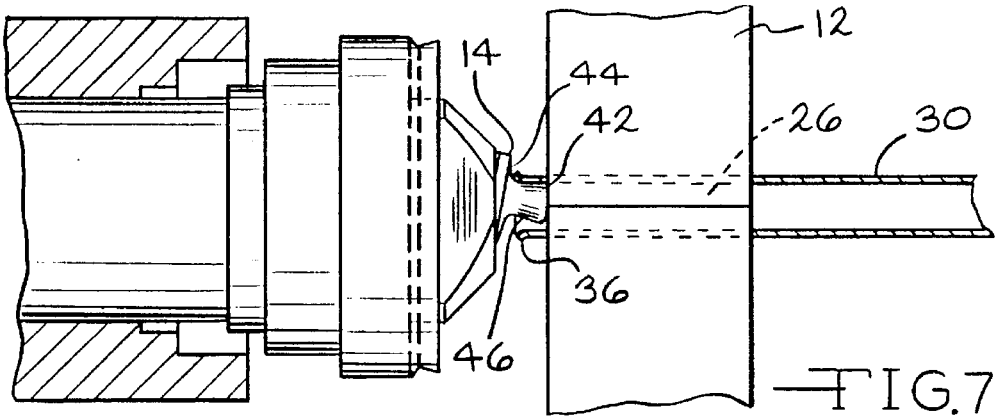
FIG. 7 is a side elevational view showing the insertion end and the center portion of the tip inserted in the tube.
Figure 8:
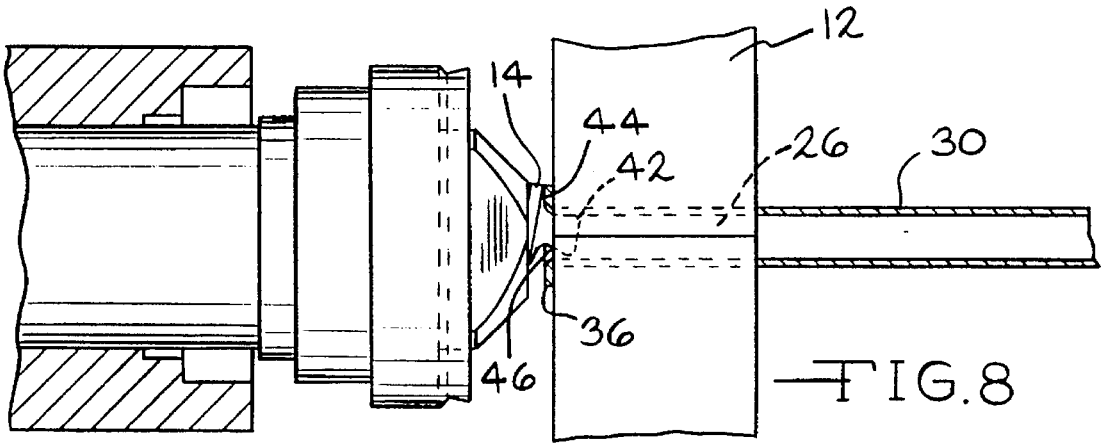
FIG. 8 is a side elevational view showing the insertion end, center portion and tapered end of the tip inserted in the tube to form a flange on the tube.

Referring to FIGS. 1, 2 and 6, the device 10 includes a tip 14. The tip 14 has a tip axis B that extends longitudinally therethrough as shown in FIGS. 1 and 2. The tip 14 includes an insertion end 42, a tapered end 44 and a center portion 46 extending between the insertion and tapered ends 42 and 44. The insertion and tapered ends 42 and 44 have larger diameters than the diameter of the center portion 46. The insertion end 42 of the tip 14 has a diameter larger than the inside diameter 1 of the tube 30. The center portion 46 of the tube 30 has a diameter smaller than the inside diameter 1 of the tube 30. The tapered end 44 of the tube 30 has a diameter larger than the inside diameter 1 of the tube 30. As shown in FIG. 2, the tip 14 has a truncated hyperbolioidal shape. The term "hyperbolioidal" is defined herein as a shape that tapers from a larger diameter at a first end to a smaller diameter in the center to a larger diameter at a second end.

As shown in FIGS. 1 and 6, the tip axis B is at a predetermined angle X with respect to the tube axis A. The predetermined angle can be in the range from about 5" to about 15°, with 10° being preferred. As described below this predetermined angle allows the tip 14 to properly engage the edge 36 of the tube 30 to form a flange.

Figure 10:
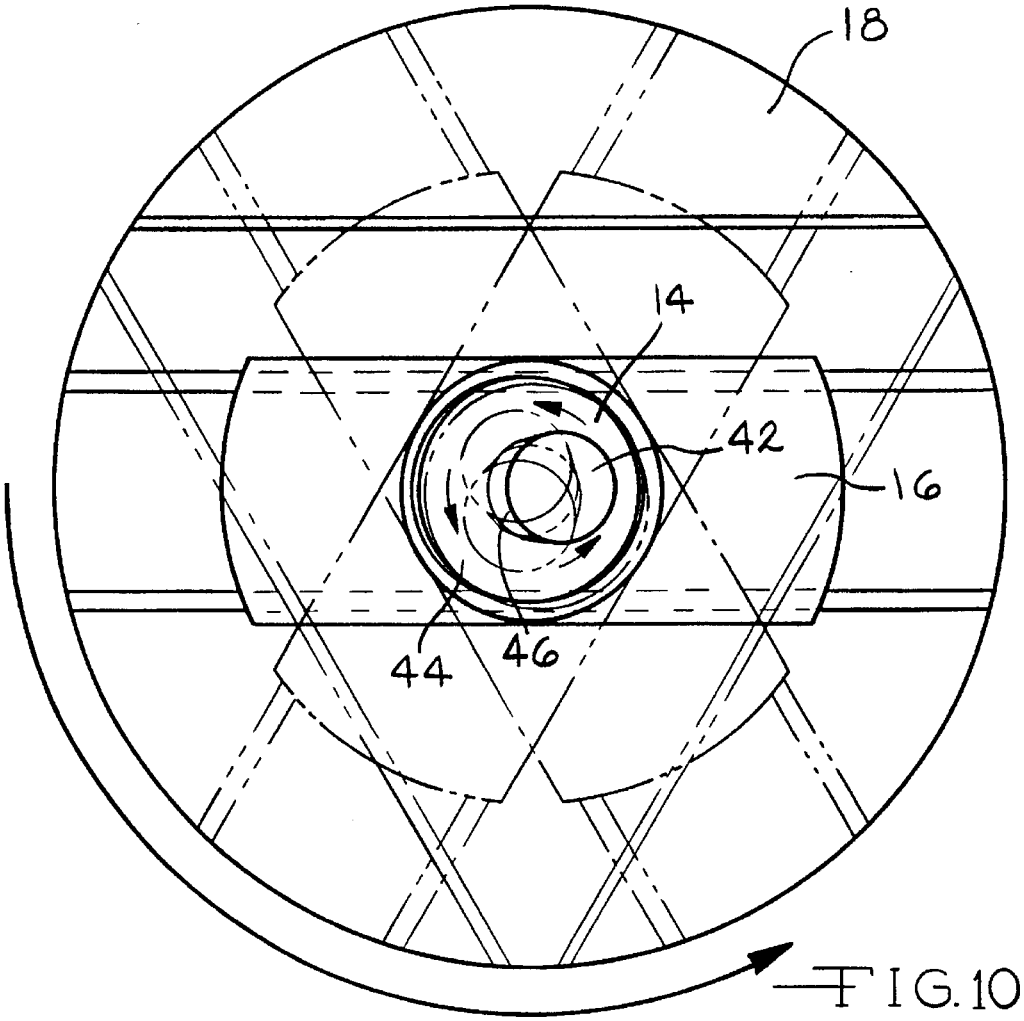
FIG. 10 is a front elevational view of the head, slide and tip of the device shown in FIG. 1 showing the two axes of rotation of the tip with respect to the tube.

As shown in FIG. 2, the tip 14 is mounted on the slide 16. Bearings 50 are positioned between the tapered end 44 of the tip 14 and the slide 16. This allows the tip 14 to freely rotate about tip axis B. As shown in FIG. 1, the slide 16 is mounted on the head 18. The head 18 is connected to the shank 20. The shank 20 is rotated by the drive motor 22 that is connected to the shank 20 by the drive belt 24. The interconnection of the shank 20 with the tip 14 causes the tip 14 to rotate along tube axis A which is coincident with the longitudinal axis of the shank 16. As shown in FIG. 10, the tip 14 rotates along both the tube and tip axes A and B, respectively, as indicated by the arrows. The rotation of the tip 14 along both axes A and B causes the tip to "wobble" around the edge 36 of the tube 30. The tip 14 is rotated at a predetermined speed. It has been found that the preferred speed is 500 rpm. The speed can vary depending on the application.

As shown in FIG. 6, the rotating tip 14 is inserted in the opening 38 of the tube 30. The tip 14 engages the edge 36 to cause the edge to contact the predetermined flange shape surface 34 to form a flange 52 on the tube 30. As shown in FIGS. 6 through 9, the insertion end 42 of the tip 14 expands the edge 36 of the tube 30. The center portion 46 of the tip 14 shapes the edge 36. Finally, the tapered end 44 of the tip 14 presses the edge 36 against the flange shape surface 34 to form the edge into the flange 52. It has been found that the present invention results in a flange on a tube that has superior mechanical properties due to the integrity of the tube wall at the junction between the flange and the tube. In prior art flanges, the tube wall would become weaker due to the deformation of the metal around the edge of the tube during formation of the flange. The present method, in which the tip has a hyperbolioidal shape and rotation on two axes, provides a superior flange on the tube.

Figure 3:
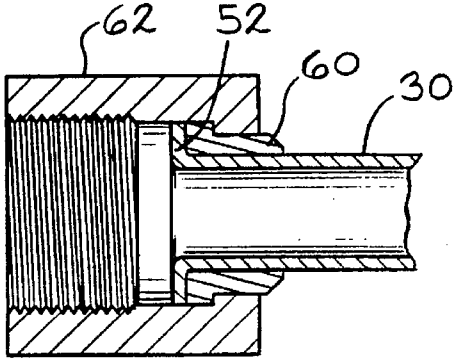
FIG. 3 is a cross-sectional view taken through the center of the tube having a flange formed by the method according to the present invention with a sleeve and a nut positioned adjacent the flange.
Figure 4:
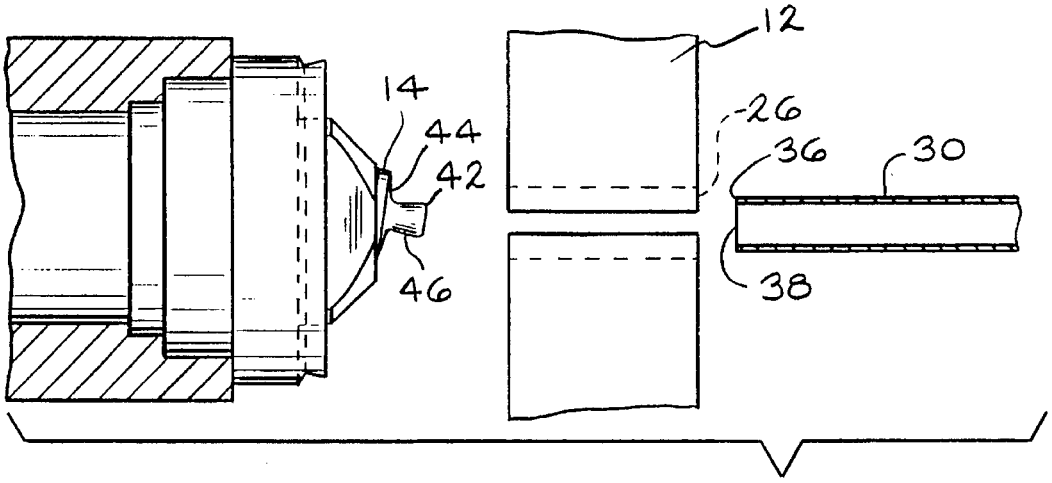
FIG. 4 is a side elevational view showing the tip, die and tube prior to insertion of the tube in the die.

Referring to FIG. 3, a sleeve 60 and a nut 62 can be placed adjacent the tube 30 and flange 52 after the flange has been formed. The nut 62 is used to connect the tube 30 to another member.

Experimental data are set forth in the example as follows:

EXAMPLE

A tube having an outside diameter of 0.5 inch with a 0.049 inch wall thickness and an inside diameter of 0.402 inch was placed on a die having a tube opening adjacent a tube stop. The tube stop was positioned 0.115 inch from the tube opening on the die. The die included a flange shape surface adjacent the tube opening. The flange shape surface had the shape of the flange to be formed on the tube. The tube had a tube axis that extended longitudinally therethrough. The tube included an edge that defined an opening. The edge was positioned adjacent the tube stop on the die so that 0.115 inch of the tube was positioned between the flange shape surface of the die and the tube stop.

A tip was positioned adjacent the edge of the tube. The tip had a tip axis extending longitudinally therethrough. The tip had a hyperbolioidal shape. The tip included an insertion end, a tapered end and a center portion between the ends. The insertion end had a diameter that was larger than the inside diameter of the tube. The center portion of the tip had a diameter that was smaller than the inside diameter of the tube. The tapered end of the tip had a diameter that was larger than the inside diameter of the tube. The tip was positioned with respect to the tube so that the tip axis was at a 10° angle with respect to the tube axis. The tip had the ability to rotate along the tube and tip axes. The tip was rotated at 500 rpm. The rotating tip was inserted in the opening defined by the edge on the tube. The tip was moved toward the edge of the tubing. The tip engaged the edge of the tube for approximately 4 seconds. During this time, the insertion end expanded the edge of the tube, the center of the tip shaped the edge and the tapered portion of the tip came in contact with the edge and formed the edge into a flange by pressing the edge against the flange shape surface of the die.

After the flange was formed on the tube, the tube was removed from the die. A sleeve and a nut were positioned adjacent the flange for future use.

The above detailed description of the present invention is given for explanatory purposes. It will be apparent to those skilled in the art that numerous changes and modifications can be made in the example of the invention described above without departing from the scope of the invention. Accordingly, the whole of the foregoing description is to be construed in an illustrative and not a limitative sense, the scope of the invention being defined solely by the appended claims.

We claim:

1. A method for forming a flange comprising the steps of:

(a) placing a tube having an inside diameter and a tube axis extending longitudinally therethrough on support means for supporting said tube, said tube having an edge defining an opening, said support means having a predetermined flange shape surface adjacent said edge;

(b) positioning a tip adjacent said edge, said tip having an insertion end, a tapered end and a center portion extending between said insertion and tapered ends, said insertion end having a diameter larger than said inside diameter of said tube, said center portion having a diameter smaller than said inside diameter of said tube, said tapered end having a diameter larger than said inside diameter of said tube, said tip having a tip axis extending longitudinally therethrough, said tip axis being at a predetermined angle with respect to said tube axis, said tip rotating along said tube and tip axes;

(c) inserting said rotating tip in said opening of said tube; and (d) engaging said edge of said tube with said tip to cause said insertion end to expand said edge, said center portion to shape said edge and said tapered end to press said edge against said flange shape surface to form a flange on said tube.

2. The method of claim 1, wherein said tube has an outside diameter of 0.50 inch with a predetermined wall thickness.

3. The method of claim 2, wherein said predetermined wall thickness is in the range from about 0.035 inch to about 0.070 inch.

4. The method of claim 3, wherein said predetermined wall thickness is approximately 0.049 inch.

5. The method of claim 1, wherein said support means is a die defining a tube opening for receiving said tube.

6. The method of claim 5, wherein said die includes a tube stop positioned a predetermined distance from said tube opening.

7. The method of claim 6, wherein said predetermined distance is in the range from about 0.110 inch to about 0.120.

8. The method of claim 7, wherein said predetermined distance is approximately 0.115 inch.

9. The method of claim 5, wherein said predetermined flange shape surface is adjacent said tube opening.

10. The method of claim 1, wherein said predetermined angle is in the range from about 5° to about 15°.

11. The method of claim 10, wherein said predetermined angle is approximately 10°.

12. The method of claim 1, wherein said tip is rotated at a predetermined speed.

13. The method of claim 12, wherein said predetermined speed is approximately 500 rpm.

14. The method of claim 1, further including the steps of:

(e) removing said tube from said support means; and (f) positioning a sleeve and a nut adjacent said flange.

* * * * *

UNITED STATES PATENT AND TRADEMARK OFFICE

CERTIFICATE OF CORRECTION

PATENT NO. : 5,622,071
DATED : April 22, 1997
INVENTOR(S) : Philip C. Van Riper and Gene A. Ellerbrock It is certified that error appears in the above-indentified patent and that said Letters Patent is hereby corrected as shown below:

In col. 2, line 51, delete "0" and insert -- O --.

In col. 2, line 51, delete "diameter 1" and insert -- diameter I --.

In col. 2, line 52, delete "diameter 0" and insert -- diameter O --.

In col. 2, line 57, delete "0" and insert -- O --.

In col. 2, line 58, delete "diameter 1" and insert -- diameter I --.

In col. 3, line 3, delete "diameter 1" and insert -- diameter I --.

UNITED STATES PATENT AND TRADEMARK OFFICE

CERTIFICATE OF CORRECTION

PATENT NO. : 5,622,071
DATED : April 22, 1997
INVENTOR(S) : Philip C. Van Riper and Gene A. Ellerbrock It is certified that error appears in the above-indentified patent and that said Letters Patent is hereby corrected as shown below:

In col. 3, line 4, delete "diameter 1" and insert -- diameter I --.

In col. 3, line 6, delete "diameter 1" and insert -- diameter I --.

In col. 3, line 13, delete "5"" and insert -- 5° --.

Signed and Sealed this

First Day of July, 1997

Bruce Lehman

*Attest:*

BRUCE LEHMAN

*Attesting Officer*

*Commissioner of Patents and Trademarks*